US009192796B2

(12) United States Patent
Patil et al.

(10) Patent No.: US 9,192,796 B2
(45) Date of Patent: Nov. 24, 2015

(54) METHOD OF DONNING AND TESTING ABRASIVE BLAST RESPIRATOR

(71) Applicant: Honeywell International Inc., Morristown, NJ (US)

(72) Inventors: Swapnil Gopal Patil, Maharashtra (IN); Joseph Rodrigues, Cranston, RI (US); Joseph Venagro, Cranston, RI (US)

(73) Assignee: Honeywell International Inc., Morristown, NJ (US)

( * ) Notice: Subject to any disclaimer, the term of this patent is extended or adjusted under 35 U.S.C. 154(b) by 383 days.

(21) Appl. No.: 13/683,730

(22) Filed: Nov. 21, 2012

(65) Prior Publication Data

US 2014/0116430 A1 May 1, 2014

Related U.S. Application Data

(63) Continuation-in-part of application No. 13/638,013, filed on Nov. 21, 2012.

(30) Foreign Application Priority Data

Oct. 25, 2012 (IN) ..... 3285/DEL/2012

(51) Int. Cl.
*A62B 18/02* (2006.01)
*A62B 7/10* (2006.01)
(Continued)

(52) U.S. Cl.
CPC ..... *A62B 18/082* (2013.01); *A62B 7/10* (2013.01); *A62B 23/02* (2013.01); *A62B 18/02* (2013.01)

(58) Field of Classification Search
CPC ..... A62B 18/08; A62B 17/04; A62B 17/00; A62B 18/00; A62B 18/006; A62B 18/082; A62B 18/025; A62B 18/084; A62B 23/02; A62B 23/00; A62B 18/02; A62B 19/00; A62B 7/10; A62B 18/10; A62B 7/00; A62B 9/04; B23P 17/00; B29C 63/22; B29C 45/14311
USPC ..... 128/201.22, 201.23, 201.25, 201.28, 128/201.19, 204.23, 205.12, 201.24, 128/207.12, 206.12, 206.15, 206.17, 128/206.22, 206.24, 206.28, 201.15, 857, 128/201.29, 205.25, 205.27, 205.29, 128/206.21, 206.23, 206.19; 2/9, 429, 434, 2/427
See application file for complete search history.

(56) References Cited

U.S. PATENT DOCUMENTS 2,529,106 A * 11/1950 Schauweker ..... 128/201.25
3,291,126 A 12/1966 Messick
(Continued)

FOREIGN PATENT DOCUMENTS

EP 1810648 A1 7/2007
WO 9741815 11/1997

OTHER PUBLICATIONS rpb® nova 3®, Ultra Performance, Heavy Industry Respirator, IS99001 Accredited Company; www.rpbsafety.com; 4 pages.
(Continued)

*Primary Examiner* — Annette Dixon
(74) *Attorney, Agent, or Firm* — Conley Rose, P.C.; Kristin Jordan Harkins

(57) ABSTRACT

Embodiments of methods of donning and/or testing an abrasive blast respirator may be described herein. The method may comprise one or more of the following, by way of example: placing head straps over a head of a user, wherein the head straps are coupled to an abrasive blast respirator, pulling a hood of the abrasive blast respirator over the head of the user, checking a seal of a facepiece of the abrasive blast respirator by blocking an opening of an exhalation valve coupled to the facepiece and exhaling by the user, where the opening of the exhalation valve is located on an outside of the abrasive blast respirator, and checking the seal of the facepiece by blocking one or more breathing filter coupled to the outside of the facepiece and inhaling by the user.

20 Claims, 11 Drawing Sheets

(51) Int. Cl.

| | |
|---|---|
| ***A62B 23/02*** | (2006.01) |
| ***A62B 18/08*** | (2006.01) |

(56) References Cited

U.S. PATENT DOCUMENTS

| | | | | | |
|---|---|---|---|---|---|
| 3,739,774 | A | | 6/1973 | Gregory | |
| 3,945,044 | A | | 3/1976 | McGee et al. | |
| 3,963,021 | A | | 6/1976 | Bancroft | |
| 4,076,373 | A | | 2/1978 | Moretti | |
| 4,127,130 | A | | 11/1978 | Naysmith | |
| 4,256,386 | A | | 3/1981 | Herbert | |
| 4,414,973 | A | * | 11/1983 | Matheson et al. | 128/206.15 |
| 4,494,538 | A | | 1/1985 | Ansite | |
| 4,542,538 | A | | 9/1985 | Moretti et al. | |
| 4,648,394 | A | * | 3/1987 | Wise | 128/201.24 |
| 4,846,166 | A | | 7/1989 | Willeke | |
| 4,873,972 | A | * | 10/1989 | Magidson et al. | 128/206.12 |
| 4,886,058 | A | * | 12/1989 | Brostrom et al. | 128/206.12 |
| 4,930,539 | A | | 6/1990 | van Rooy | |
| 4,961,420 | A | | 10/1990 | Cappa et al. | |
| H0863 | H | * | 1/1991 | Kwiedorowicz et al. | 2/424 |
| 4,989,598 | A | | 2/1991 | Berg et al. | |
| 5,299,448 | A | * | 4/1994 | Maryyanek et al. | 73/40 |
| 5,431,156 | A | | 7/1995 | Sundstrom | |
| 5,549,104 | A | | 8/1996 | Crump et al. | |
| 6,102,033 | A | | 8/2000 | Baribeau et al. | |
| 6,408,845 | B1 | * | 6/2002 | Pereira et al. | 128/202.22 |
| 7,293,560 | B2 | | 11/2007 | Dahrendorf et al. | |
| 7,464,705 | B2 | | 12/2008 | Tanizawa et al. | |
| 7,762,252 | B2 | | 7/2010 | Prete | |
| 7,975,688 | B1 | | 7/2011 | Truitt | |
| 8,028,695 | B2 | | 10/2011 | Acker et al. | |
| 8,176,913 | B2 | | 5/2012 | Ivory | |
| 8,402,966 | B2 | | 3/2013 | Morgan, III et al. | |
| 8,707,472 | B2 | | 4/2014 | Stachler et al. | |
| 2009/0194101 | A1 | | 8/2009 | Kenyon et al. | |
| 2009/0241965 | A1 | | 10/2009 | Sather et al. | |
| 2009/0266361 | A1 | | 10/2009 | Bilger et al. | |
| 2010/0287688 | A1 | | 11/2010 | Stachler et al. | |
| 2011/0036347 | A1 | * | 2/2011 | Morgan et al. | 128/201.19 |
| 2012/0152255 | A1 | | 6/2012 | Barlow et al. | |
| 2014/0115864 | A1 | | 5/2014 | Palil et al. | |
| 2014/0116429 | A1 | | 5/2014 | Patil et al. | |

OTHER PUBLICATIONS rpb® nova 3®, Ultra Performance, Heavy Industry Respirator, 1S99001 Accredited Company; www.rpbsafety.com; 4 pages.

MSA The Safety Company: Advantage® 4000 Abrasi-Blast™ Respirator, Information Sheet, msanet.com, 8 pages, 2011.

Clemco; www.clemcoindustries.com, Job No. 2317-0506, Rev. C 0111; Apollo 600 Supplied—Air Respirator for Abrasive Blasting; 4 pages, 2011.

rpb® nova 3®, Ultra Performance, Heavy Industry Respirator, IS99001 Accredited Company; www.rpbsafety.com; 4 pages, 2011.

Bullard 88VX™ Series Airline Respirator User Manual; 20 pages, 2011.

PCT/US2011/044229; International Preliminary Report on Patentability and Written Opinion; Jan. 22, 2013; 6 pages.

* cited by examiner

METHOD OF DONNING AND TESTING ABRASIVE BLAST RESPIRATOR

CROSS-REFERENCE TO RELATED APPLICATIONS

This application claims priority to India Provisional Patent Application Serial No. 3285/DEL/2012, filed Oct. 25, 2012 in the India Patent Office.

This application claims priority to U.S. patent application Ser. No, 13/683,013, entitled "Abrasive Blast Respirator", filed Nov. 21, 2012 in the U.S. Patent Office.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Abrasive blasting is a common surface preparation technique used in ship building, ship maintenance, and other industrial activities to remove old paint and other surface materials such as rust, mill scale, dirt, salts, and other impurities. In some contexts this procedure may be referred to as sand blasting. The abrasive blasting may be conducted to prepare a surface for painting and/or for treatment with a corrosion inhibitor. In abrasive blasting, compressed air may be used to propel abrasive material and to direct the abrasive material on the work area at a relatively high velocity. The operator or blaster may manipulate a wand that comprises a nozzle for directing the abrasive material. In some applications, air pressure used in blasting may be as high as 100 PSI, and nozzle velocities of abrasive material may be between 650 feet per second to 1,700 feet per second. Abrasive blasting may be conducted in confined spaces.

During abrasive blasting, abrasive material may bounce back or ricochet onto the blasting operator. Further, during abrasive blasting, a blasting operator may be subjected to a direct blast, for example if one blasting operator accidently directs a blast on another blasting operator or if a blasting operator drops his blasting tool, and the blasting tool directs the blast upon the blasting operator. It is prudent, and may be required by law and/or regulation, that the blasting operator use respiratory protection, eye protection, and face protection while blasting to avoid injury from either bounce back or direct blasting.

SUMMARY

In an embodiment, a method of donning an abrasive blast respirator is disclosed. The method may comprise one or more of the following: placing head straps over a head of a user, wherein the head straps are coupled to an abrasive blast respirator, pulling a hood of the abrasive blast respirator over the head of the user, checking a seal of a facepiece of the abrasive blast respirator by blocking an opening of an exhalation valve coupled to the facepiece and exhaling by the user, where the opening of the exhalation valve is located on an outside of the abrasive blast respirator (typically exterior to the hood), and checking the seal of the facepiece by blocking one or more breathing filter(s) coupled to the outside of the facepiece (typically exterior to the hood) and inhaling by the user.

In another embodiment, a method of testing a seal of an abrasive blast respirator is disclosed (for example, a positive seal check). The method may comprise checking a seal of a facepiece of the abrasive blast respirator by blocking an opening of an exhalation valve coupled to the facepiece and exhaling by the user, where the opening of the exhalation valve is located on an outside of the abrasive blast respirator (typically external to a hood of the respirator).

In another embodiment, a method of testing a seal of an abrasive blast respirator is disclosed. The method may comprise checking the seal of a facepiece of the abrasive blast respirator by blocking one or more breathing filter(s) coupled to the outside of the facepiece (typically external to the hood of the respirator) and inhaling by the user.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

Methods of donning an abrasive blast respirator and methods of testing a seal of a facepiece of an abrasive blast respirator pursuant to using the respirator are taught. The structure and configuration of an exemplary abrasive blast respirator are described first before describing the methods of donning, doffing, and testing, as a general understanding of the structure of the exemplary abrasive blast respirator contributes to ease of understanding the description of the methods. For further details about an exemplary abrasive blast respirator see related U.S. Patent Application File No. H0037503_4341-13900 which is incorporated by reference in its entirety. It should be understood, however, that specific structure may not be required for various method embodiments described herein.

Figure 1:
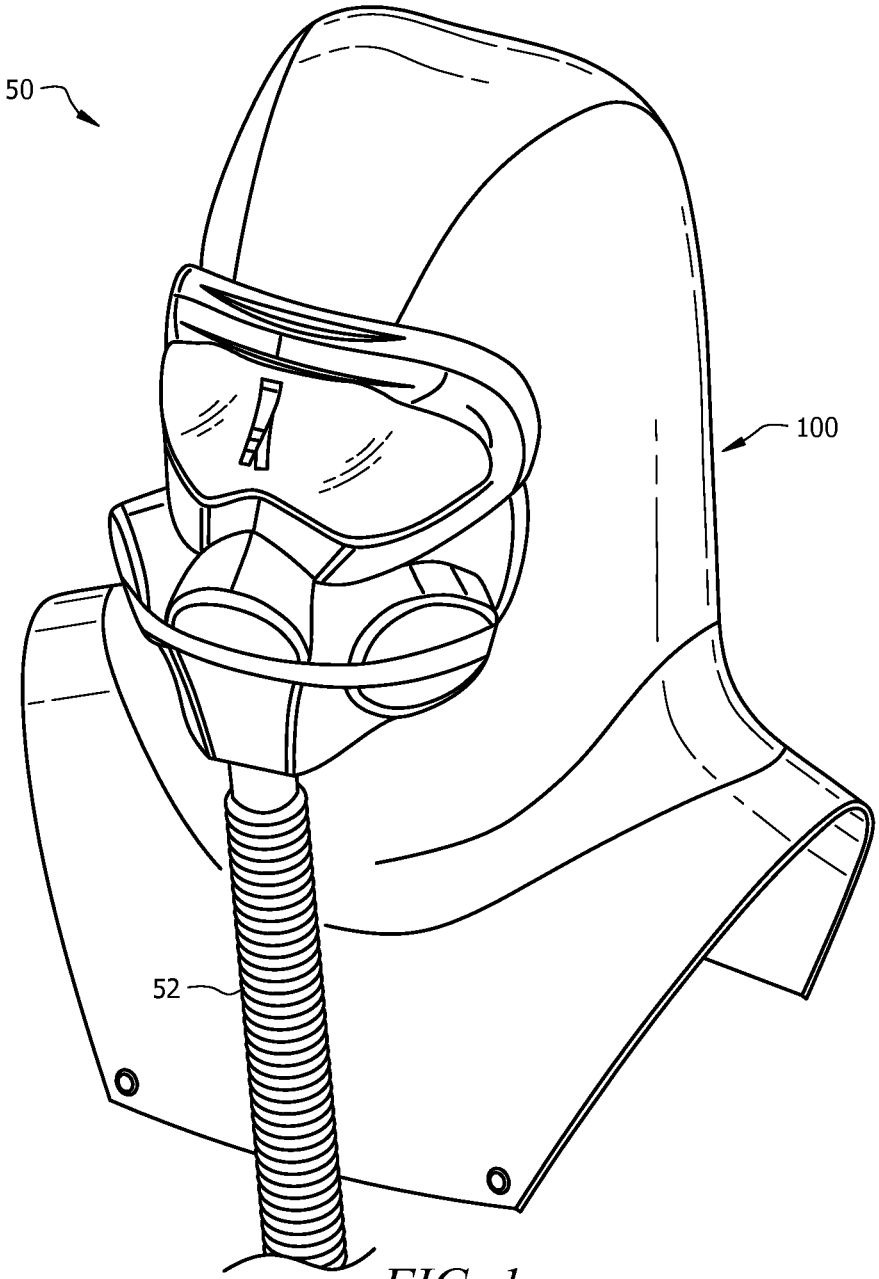
FIG. 1 is an illustration of an exemplary abrasive blast respirator according to an embodiment of the disclosure.

Turning now to FIG. 1, an embodiment of a supplied-air abrasive blast respirator 50 is described. In an embodiment, the abrasive blast respirator 50 comprises a breathing hose assembly 52 (for providing supplied air to the respirator, typically at pressure) and a respirator assembly 100. The abrasive blast respirator 50 may be suitable for use in performing abrasive blasting operations, for example for cleaning and/or preparing metal surfaces for painting and/or applying anti-corrosion materials. In an embodiment, the abrasive blast respirator 50 may be employed in ship maintenance and building operations. The abrasive blast respirator 50 may be employed in refinery maintenance and building operations. The abrasive blast respirator 50 may be employed in other operations as well. The abrasive blast respirator 50 is configured to provide protection to an abrasive blast operator, typically providing respiratory protection, eye protection, and face protection.

The abrasive blast respirator 50 may be used for blasting operations by an operator working in tight quarters, for example crawling between pipes, in the interior of a small enclosure, or other confined space. In an embodiment, the abrasive blast respirator 50 affords a wide field of view for the user. The abrasive blast respirator 50 of FIG. 1 comprises a soft, (flexible) deformable hood that flexes somewhat as the blast operator moves, which may promote increased comfort under some operating conditions. Additionally, use of a soft, deformable hood on the user's head, rather than a rigid hood covering such as a helmet, may be beneficial for allowing the operator to enter confined spaces. The breathing hose assembly 52 of FIG. 1 attaches to a front of the abrasive blast respirator 50, a configuration that may reduce entanglement problems that otherwise might be experienced if a breathing hose were attached to a back of an abrasive blast respirator.

Figure 2:
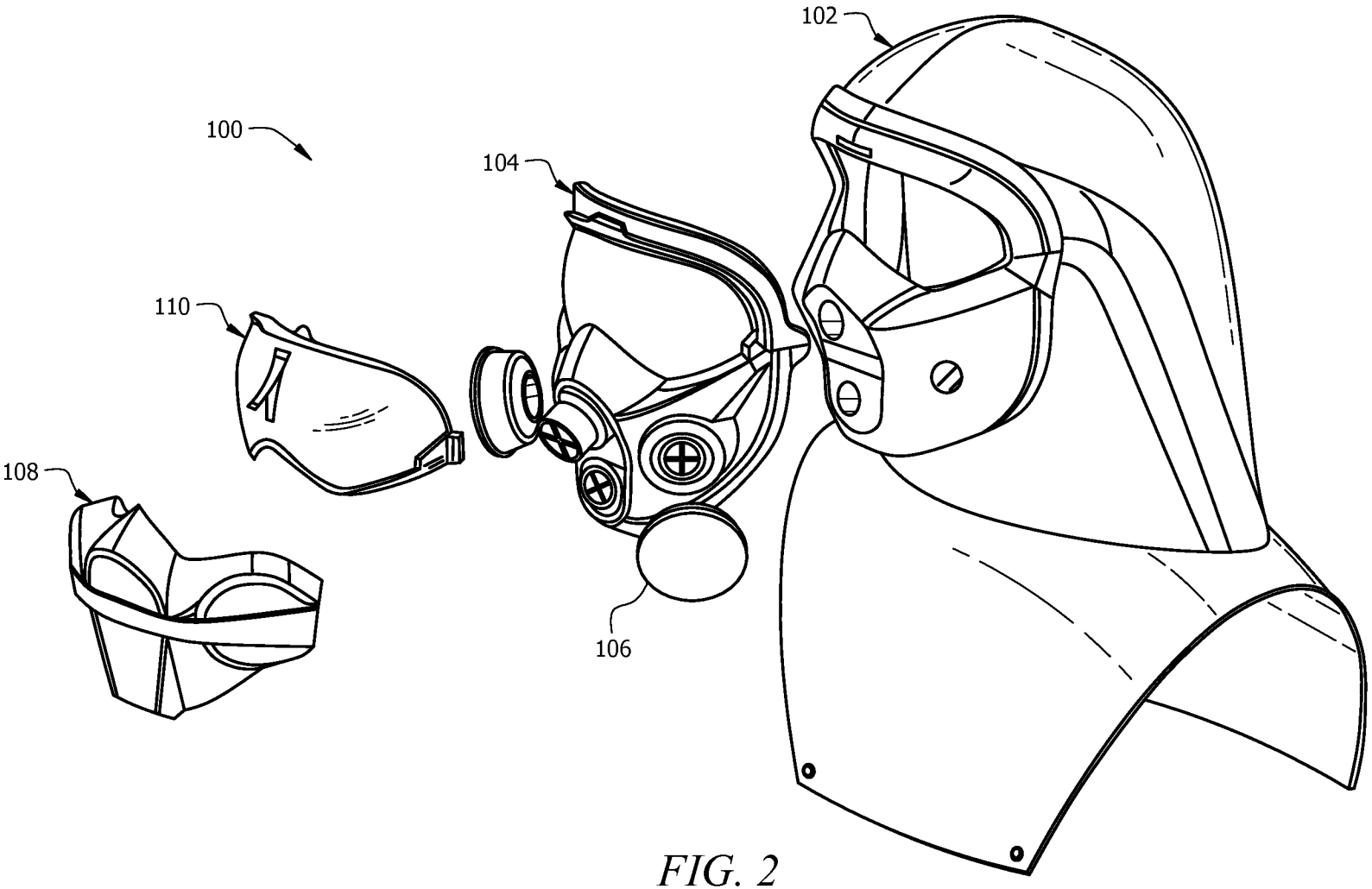
FIG. 2 is an illustration of some major components of an exemplary abrasive blast respirator according to an embodiment of the disclosure.

Turning now to FIG. 2, further details of the respirator assembly 100 are described. In an embodiment, the respirator assembly 100 may comprise a hood assembly 102, a full facepiece 104, one or more releasably attached filters 106, a releasably attached protective cover 108 (typically covering/protecting one or more elements on the front of the facepiece 104, which might for example be external to the hood), and a releasably attached lens magazine or cartridge 110. The filter(s) 106 may attach threadedly, by a snap fit, or by another releasable attachment means to a purified air inhalation valve coupled to or forming a component of the full facepiece 104. In an embodiment, the filter(s) 106 comprises a housing enclosing a filter media. The filter(s) 106 provides an air flow path from an exterior opening of the housing, through the filter media, and out an interior opening of the housing where the filter(s) 106 releasably attaches to the full facepiece 104. While two filters 106 are illustrated in FIG. 2, in an embodiment one filter 106 or more than two filters 106 may be releasably attached to the full facepiece 104. In an embodiment, the filter 106 provides a back-up source of air to a user of the supplied-air abrasive blast respirator 50 in the event that the breathing hose assembly 52 becomes inoperable for supplying air, for example if the hose becomes kinked or severed. In an embodiment, the filter(s) 106 may comprise a P100 filter made by North/Honeywell. Typically, the one or more filters 106 are located on the front of the facepiece during use, external to the hood. Such a location may simplify performing a seal check. Typically, a removable cover 108 (as shown in FIG. 2) might be removably attached over the filter(s) 106, to allow ready access while also protecting the filter(s) 106 from the abrasive blast environment. The removable cover is some embodiments might cover the filter(s), the exhalation valve, and/or the supplied-air inhalation valve (attachment point of breathing hose to the facepiece), and in some embodiments one or more protective covers could be removably attached to the front of the facepiece. Typically, the removable cover is separate and/or apart from the hood and, when in place on the facepiece, is external from the hood.

The lens magazine 110 may be releasably attached to the full facepiece 104 by mating flexible tabs on a carrier lens component of the lens magazine 110 to corresponding slots or detents in the full facepiece 104. The releasably attached protective cover 108 may be configured to snap over the one or more filters 106 and/or other elements exposed on the front of the facepiece 104. It is contemplated that the protective cover 108 and the lens magazine 110 may be released and attached to the full facepiece 104 by a blast operator who is wearing the abrasive blast respirator 50. Further, it is contemplated that the protective cover 108 and the lens magazine 110 may be released and attached by the gloved hand of the operator while wearing the abrasive blast respirator 50. And with respect to the lens magazine 110, release of one or more removable lenses from the lens magazine 110 and/or release of the lens magazine 110 from the facepiece 104 may be accomplished using a single (gloved) hand of the operator. The protective cover 108 desirably comprises a material that is resistant to erosion by abrasive particles and protects the filter 106 and other features of the full facepiece 104. In an embodiment, the protective cover 108 may comprise nylon 6 material. In another embodiment, however, the protective cover 108 may comprise material other than nylon 6. Further, the protective cover 108 desirably is configured to allow ready flow of air around its edges, for example around its lower edge, to permit air flow into the filter 106 and air flow out of an exhalation valve coupled to or forming a component of the full facepiece 104. The protective cover 108 of FIG. 2 is separate and apart from the hood 102, typically interacting with the facepiece 104 independently of the hood 102 and/or mask.

Figure 3:
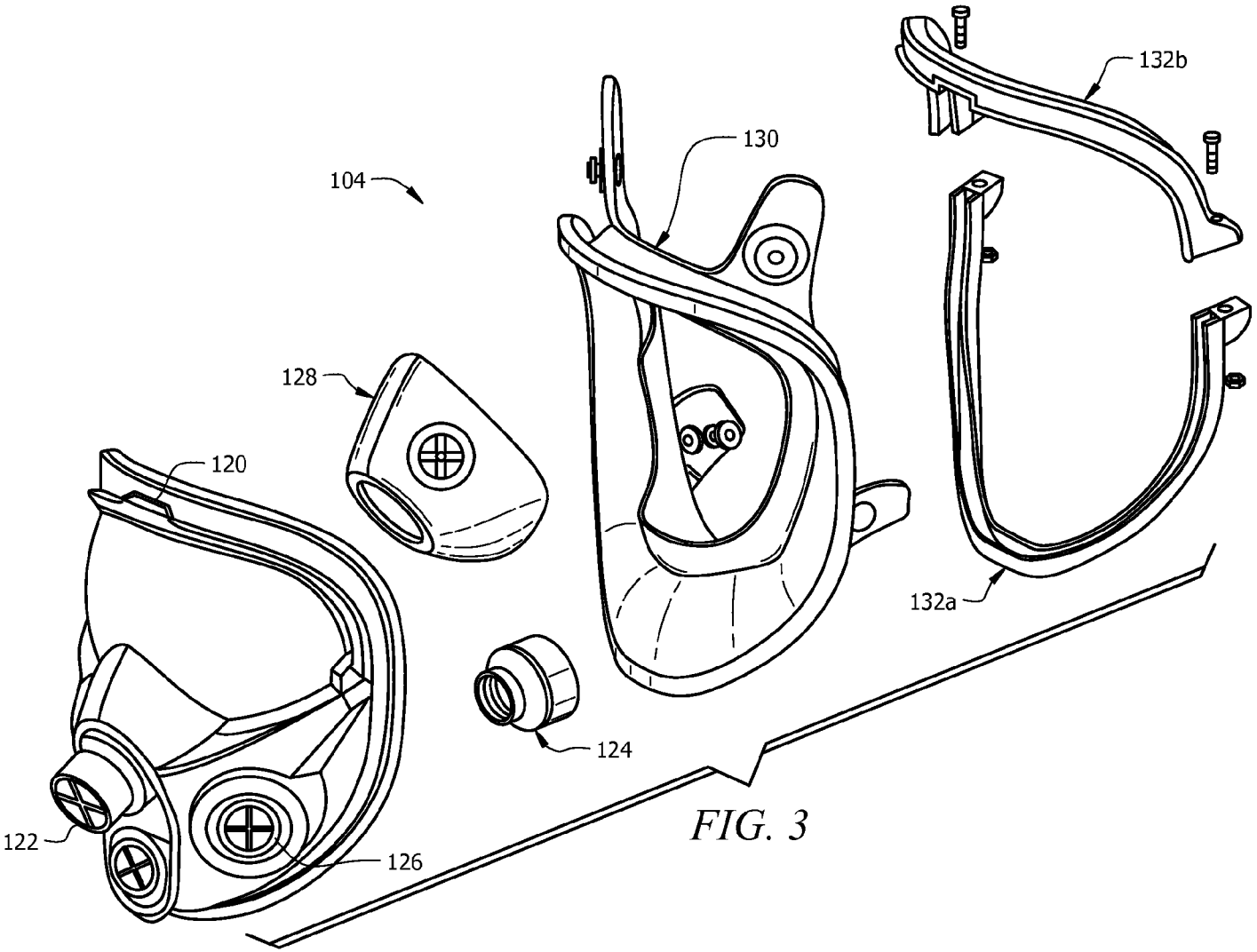
FIG. 3 is an illustration of some components of a full facepiece assembly of an exemplary abrasive blast respirator according to an embodiment of the disclosure.

Turning now to FIG. 3, further details of the full facepiece 104 are described. In an embodiment, the full facepiece 104 may comprise a base lens 120 (having viewing area with a field of vision), an exhalation valve 122, a first (supplied-air) inhalation valve 124, a second (purified air) inhalation valve (s) 126, a nose cup 128, a face seal 130, and a clamp 132 comprising an upper clamp **132*b* and a lower clamp 132*a*. The clamp 132 secures the lens 120 to the face seal 130. The upper clamp 132*b* and the lower clamp 132*a* may be placed to hold the lens 120 and the face seal 130 together, and the upper clamp 132*b* may be attached to the lower clamp 132*a* using screws, rivets, adhesive, snaps, or other retaining structure. In an embodiment, the upper amp 132***b* and the lower clamp 132*a* may be manufactured of Polyphenylene Sulfide. The lens 120 may comprise a locating feature to promote ease of installing the full facepiece 104 into the hood assembly 102, for example a tab at the top of the lens 120 that corresponds to a slot in a protective mask portion of the hood assembly 102.

A harness (not shown but typically having adjustable straps) may be coupled to the face seal 130 by buttons, rivets, buckles, or other coupling structure. The harness may be used to secure the face seal 130 to a face of a user of the abrasive blast respirator 50. The harness may be adjusted to prevent air flow around the interface of the face seal 130 with the user's face. For example, the straps of the harness may be tightened while the facepiece is position with respect to the user's face, to form a seal.

The lens 120 may be made of a material that resists impacts, and the lens 120 typically provides a relatively wide field of vision, for example at least 160 degrees of vision. By providing a greater field of vision, the abrasive blast respirator 50 may promote a user seeing to either side without turning his or her head, for example when tight quarter interfere with turning his or her head. Additionally, a wide field of vision may simplify seal check testing, especially when one or more elements that require interaction for seal check(s) are located on the front of the facepiece external to the hood (and for example located beneath the lens viewing area). The user may then utilize visual cues when performing seal checks. The lens 120 typically may be configured to provide good optical qualities. In an embodiment, the lens 120 may comprise polycarbonate material, for example LEXAN™ 103R. One of ordinary skill in the art will appreciate that the lens 104 might be constructed using other materials.

Figure 4:
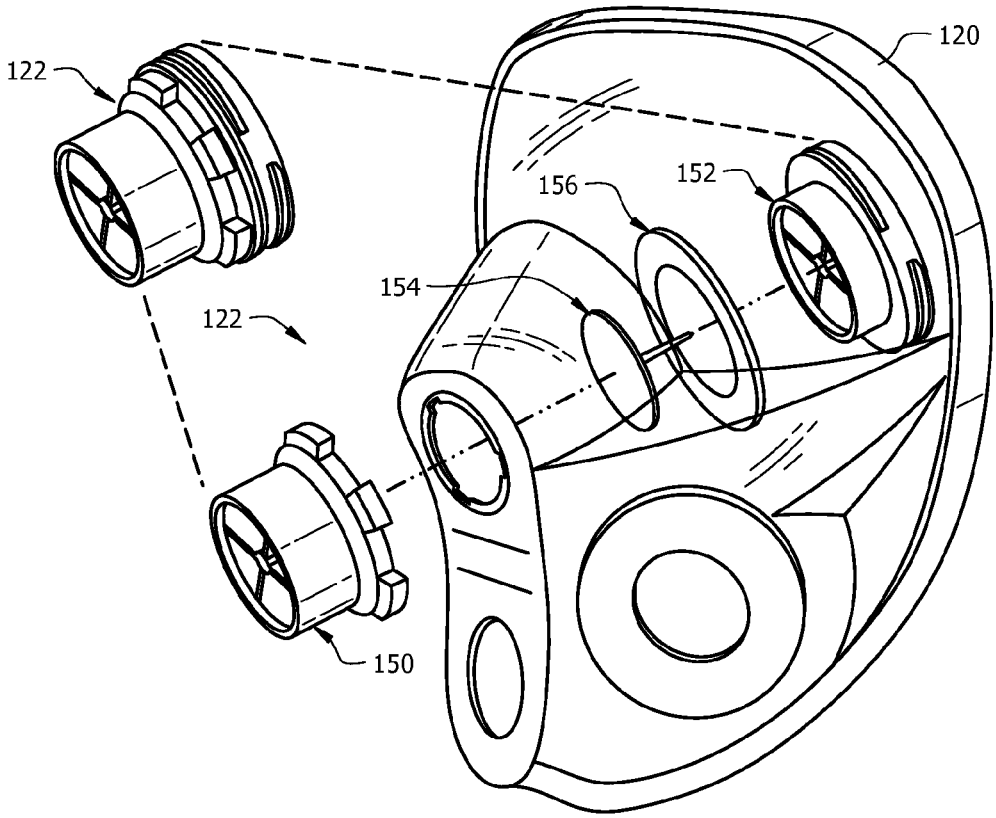
FIG. 4 is an illustration of an exemplary exhalation valve component of the full facepiece assembly according to an embodiment of the disclosure.

Turning now to FIG. 4, details of an exemplary exhalation valve 122 are described. In an embodiment, the exhalation valve 122 comprises a valve cover 150, a valve 154, a seal 156, and a valve housing 152. In an embodiment, the valve cover 150 is removably attached to the valve housing 152 by a snap fit, but in another embodiment the valve cover 150 may be releasably attached to the valve housing 152 or to the lens 120 by a different structure. The valve housing 152 may retain the seal 156 and the valve 154 when the valve housing 152 is releasably attached to the lens 120. In an embodiment, the valve housing 152 is releasably attached to the lens 104 by inserting through an aperture in the lens 120 and turning the valve housing 152 until it snaps into position. The valve housing 152 may have tabs that fit into cut outs in a lip of the aperture in the lens 120 and that engage with the lip as the valve housing 152 is rotated. In an embodiment, the configuration of the tabs on the valve housing 152 and the cut outs or slots in the lip of the aperture in the lens 120 is designed to limit insertion of the valve housing 152 into the aperture in the lens 120 to the preferred angular rotational position of the valve housing 152. In an embodiment, the valve cover 150 and the valve housing 152 comprise NORYL™ (e.g. modified PPE resins which consist of amorphous blends of PPO™ resin (e.g. polyphenylene ether) and polystyrene) SE1x material. In an embodiment, the seal 156 may comprise closed cell Epiclorohydren (ECH) foam. One of ordinary skill in the art will appreciate that the components of the exhalation valve 122 might be constructed using other materials. The exhalation valve 122 typically functions to allow air exhaled by a user wearing the respirator to exit while preventing external air from entering the respirator through the exhalation valve 122. The exhalation valve 122 may typically be located on the front of the facepiece 104, external to the hood. Such a location may provide ready access for performing seal checks (without, for example, having to move or reconfigure the hood from its standard abrasive blasting configuration). Typically, however, such an exhalation valve 122 might be shielded from the abrasive blasting environment by a protective cover 108 (as shown for example in FIG. 2) that may be removably attached to the facepiece 104.

Figure 5:
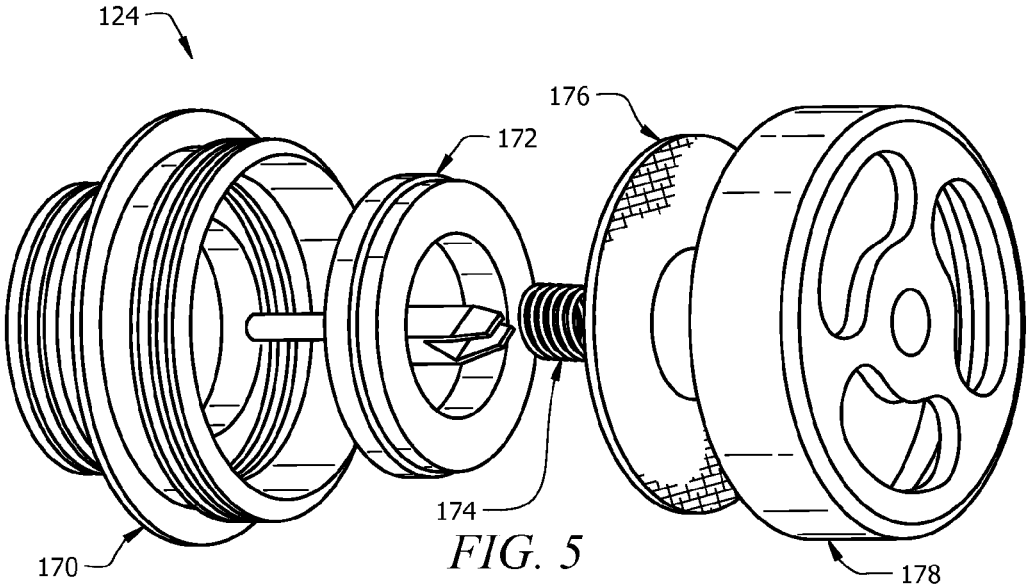
FIG. 5 is an illustration of an exemplary inhalation valve of the full facepiece assembly according to an embodiment of the disclosure.

Turning now to FIG. 5, further details of an exemplary inhalation valve 124 are described. In an embodiment, the inhalation valve 124 comprises a housing 170, a stem 172, a spring 174 or other biasing member (biasing the valve closed), an optional felt washer 176 (which may provide noise reduction), and a cover 178. In an embodiment, the housing 170, the stem 172, and the cover 178 may be comprised of Acetal and may be machined. The stem 172 may further comprise a rubber seal component. The optional felt washer 176 may be provided to attenuate noise due to turbulence. One of ordinary skill in the art will appreciate that the components of the inhalation valve 124 might be constructed using other materials. The inhalation valve 124 typically functions to allow supplied air (typically provided via a breathing hose) to enter the respirator, but preventing air from leaving the respirator. Additionally, the inhalation valve 124 of FIG. 5 might operate to prevent any air from entering the respirator though the inhalation valve 124 if the breathing hose is compromised. For example, if pressure in the breathing hose drops below a set limit (for example 1-2 PSI), the inhalation valve 124 may close and prevent any external air from entering the respirator through the inhalation valve 124. The inhalation valve 124 may typically be located on the front of the facepiece, external to the hood. Such as location may provide ready access (for attachment of the breathing hose, for example), without for example having to move or reconfigure the hood from tit standard abrasive blasting configuration. Typically, such as inhalation valve might be shielded by a protective cover that may be removably attached to the facepiece.

The housing 170 may be retained in an aperture of the lens 120 by a gasket, for example a flexible rubber gasket. The stem 172, spring 174, and optional felt washer 176 may be assembled into the housing 170 while the housing 170 is retained in the aperture of the lens 120 and then the cover 178 may be coupled to the housing 170 to retain the inhalation valve 124 in a spring biased state. For example, the cover 178 may be screwed over the housing 170. When the cover 178 is coupled to the housing 170, the cover and housing 170 cooperate to retain the inhalation valve 124 in the lens 120.

Figure 6:
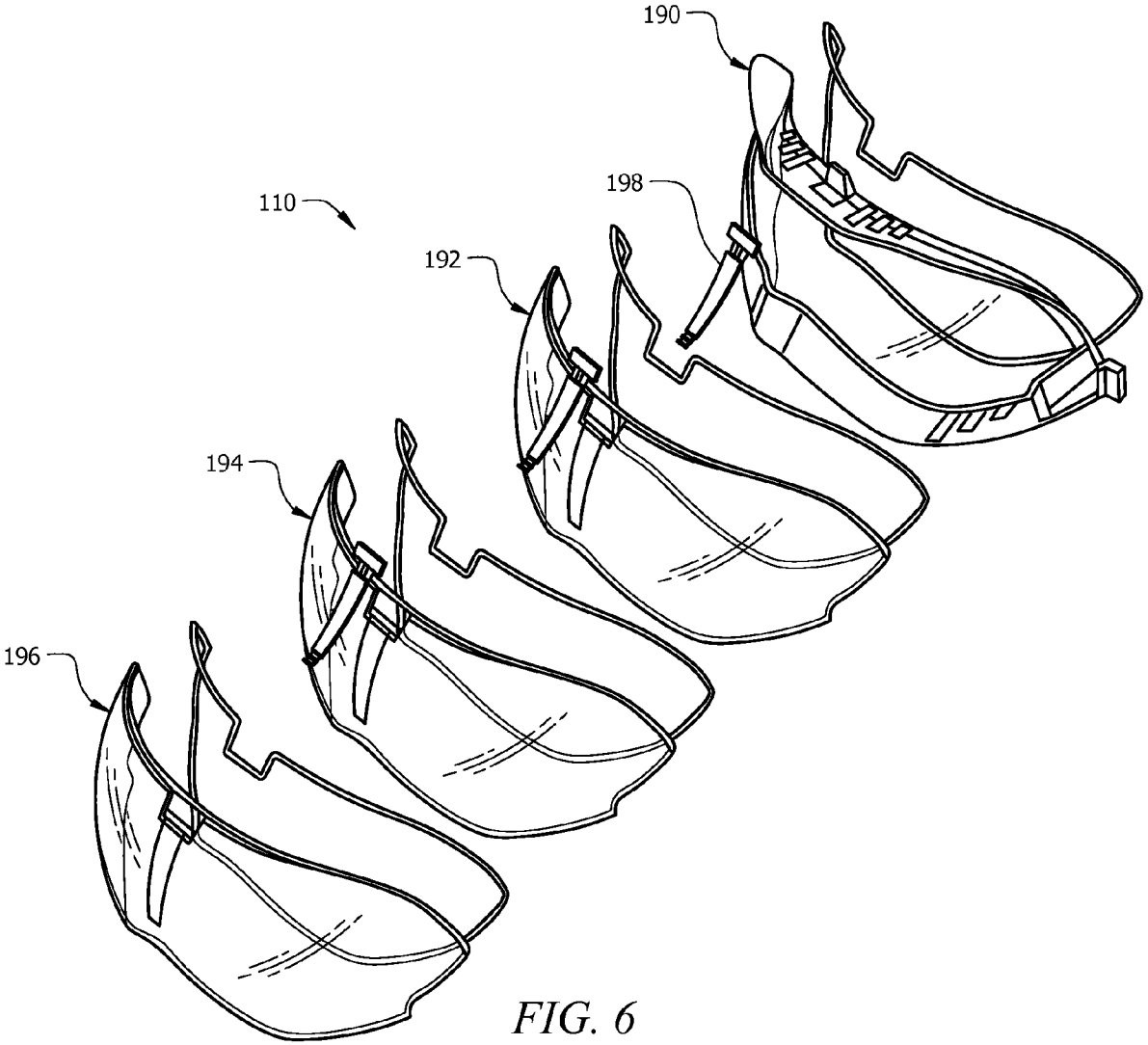
FIG. 6 is an illustration of an exemplary lens magazine or cartridge of the abrasive blast respirator according to an embodiment of the disclosure.

Turning now to FIG. 6, further details of an exemplary lens magazine 110 are described. In an embodiment, the lens magazine 110 may comprise a carrier lens 190, an inner lens 192, a middle lens 194, and an outer lens 196 (or any number of removable, sacrificial lenses atop the carrier lens 190). While the lens magazine 110 is described as having three lenses, in other embodiments the lens magazine 110 may have one lens, two lenses, or more than three lenses. In a preferred embodiment, the lenses 192, 194, 196 are not interchangeable but are configured to fit into a specific ordered position in the lens magazine 110. In an embodiment, the optical properties of the lenses 192,194, 196 may each be individually designed to take into account the other lenses and their optical interactions. In an embodiment, the lenses 192, 194, 196 are configured to have high impact resistance. In an embodiment, the lenses 192, 194, 196 may comprise polycarbonate material. One of ordinary skill in the art will appreciate that the lenses 192, 194, 196 might be constructed using other materials.

The lenses 192, 194, 196 of FIG. 6 are configured to be releasably attached to the carrier lens 190. In an embodiment, the lenses 192, 194, 196 snap into and out of retaining slots or detents formed in the carrier lens 190. The lens magazine 110 may further comprise tabs 198 (typically located on the front of a lens, perhaps in the middle towards the top edge of the lens) that are coupled to each of the lenses 192, 194, 196. For example, the tabs 198 may insert through slots in the lenses 192, 194, 196 and project out. It is contemplated that a user of the abrasive blast respirator 50 may grasp the tab 198 with a (single) gloved hand, for example when wearing the abrasive blast respirator 50 and during a working assignment, and remove the coupled lens 192, 194, 196 to expose the next underlying lens 192, 194, 196. The user may remove a lens 192, 194, 196 that has been damaged by abrasive ricochet and/or blast and hence is difficult to see through clearly. Removing the outermost lens 192, 194, 196 may allow the user to see through an as yet undamaged middle lens 194 or inner lens 192. Preferably the lens magazine 110 affords at least a 160 degree field of vision to the user of the abrasive blast respirator 50. The carrier lens 190 of FIG. 6 is configured to removably attach to the base lens of the respirator facepiece, for example by snap attachment.

Figure 7:
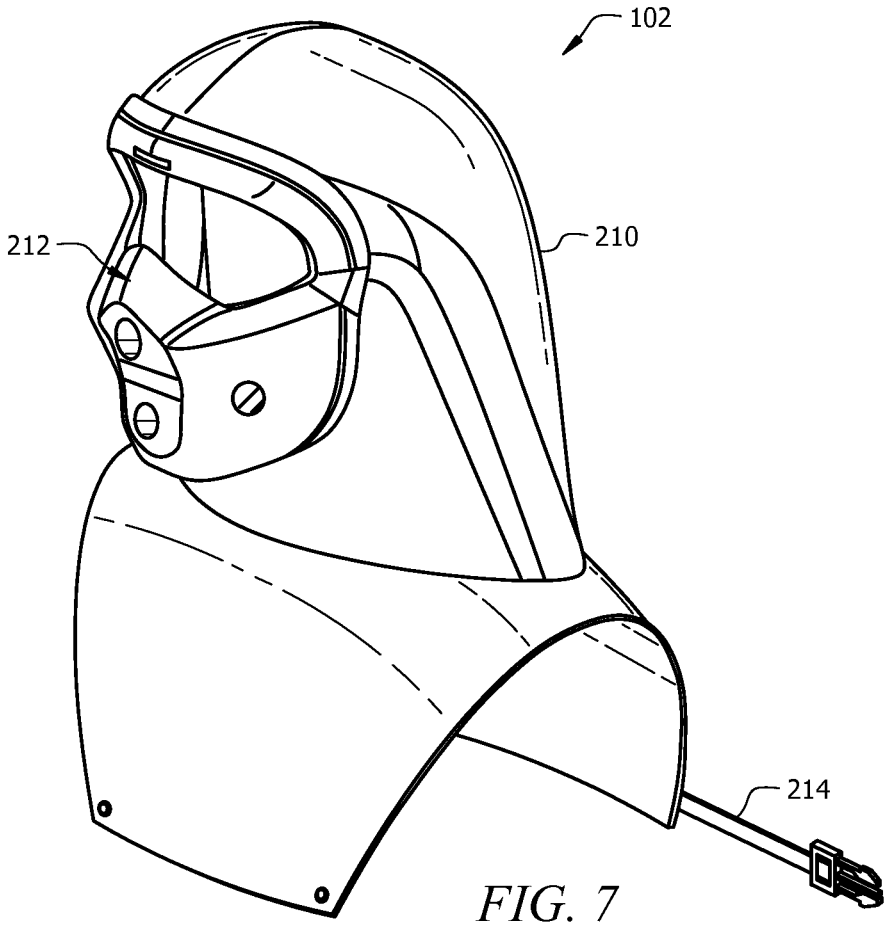
FIG. 7 is an illustration of an exemplary hood assembly of the abrasive blast respirator according to an embodiment of the disclosure.
Figure 8:
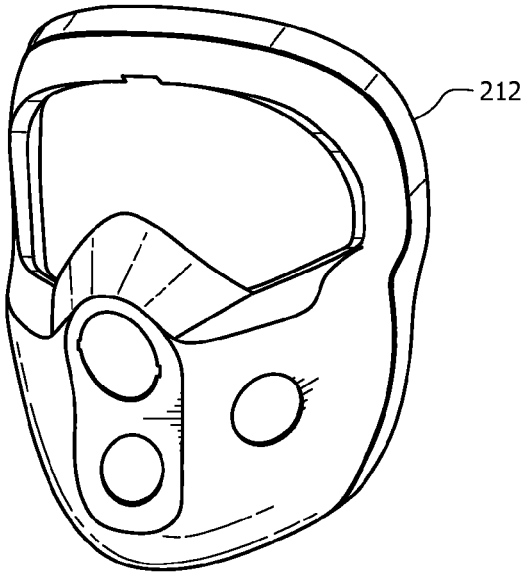
FIG. 8 is an exemplary protective mask portion of the hood assembly according to an embodiment of the disclosure.
Figure 9:
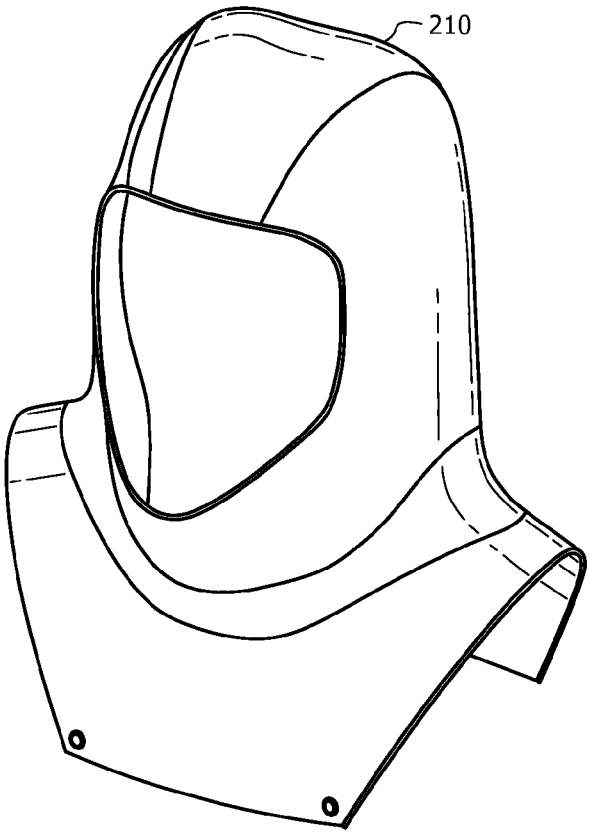
FIG. 9 is an illustration of an exemplary hood of the hood assembly according to an embodiment of the disclosure.

Turning now to FIG. 7, FIG. 8, and FIG. 9 further details of the hood assembly 102 are described. In an embodiment, the hood assembly 102 may comprise a hood 210, a protective mask 212, and one or more optional sternum straps 214. The sternum straps 214 may have a buckle component at one end that mates with a corresponding buckle component coupled to an underside or inside of the front portion of the hood 210 (or snaps or buttons might be used). The sternum straps 214 may be employed to hold the hood assembly 102 and the abrasion blast respirator 50 in place as the user has adjusted it when donning the abrasion blast respirator 50, for example to maintain a comfort of the user, to reduce the likelihood of abrasive grit entering under the hood, and to maintain an effective seal between the face of the user and the face seal 130.

The protective mask 212 may be formed of a material that protects the lower portion of the full facepiece 104 from direct blast and/or ricochet of abrasive particles. In an embodiment, the protective mask 212 may comprise TPU (thermoplastic polyurethane) material such as VERSOLLAN™ RU 2205-9. The protective mask 212 may be provided with apertures that interact with elements on the facepiece, for example receiving valves and/or filters attached to or coupled to the full facepiece 104 when it is installed into the hood assembly 102. In an embodiment, the protective mask 212 may be sewn to the hood 210. Alternatively, the protective mask 212 may be welded and/or riveted to the hood 210.

In an embodiment, the hood 210 may be formed from one or more sheets of material that may be cut and sewn or otherwise coupled at cut edges to form the desired hood shape. In an embodiment the hood 210 may comprise Urethane such as MESATHANE™ reinforced with polyester.

Figure 10:
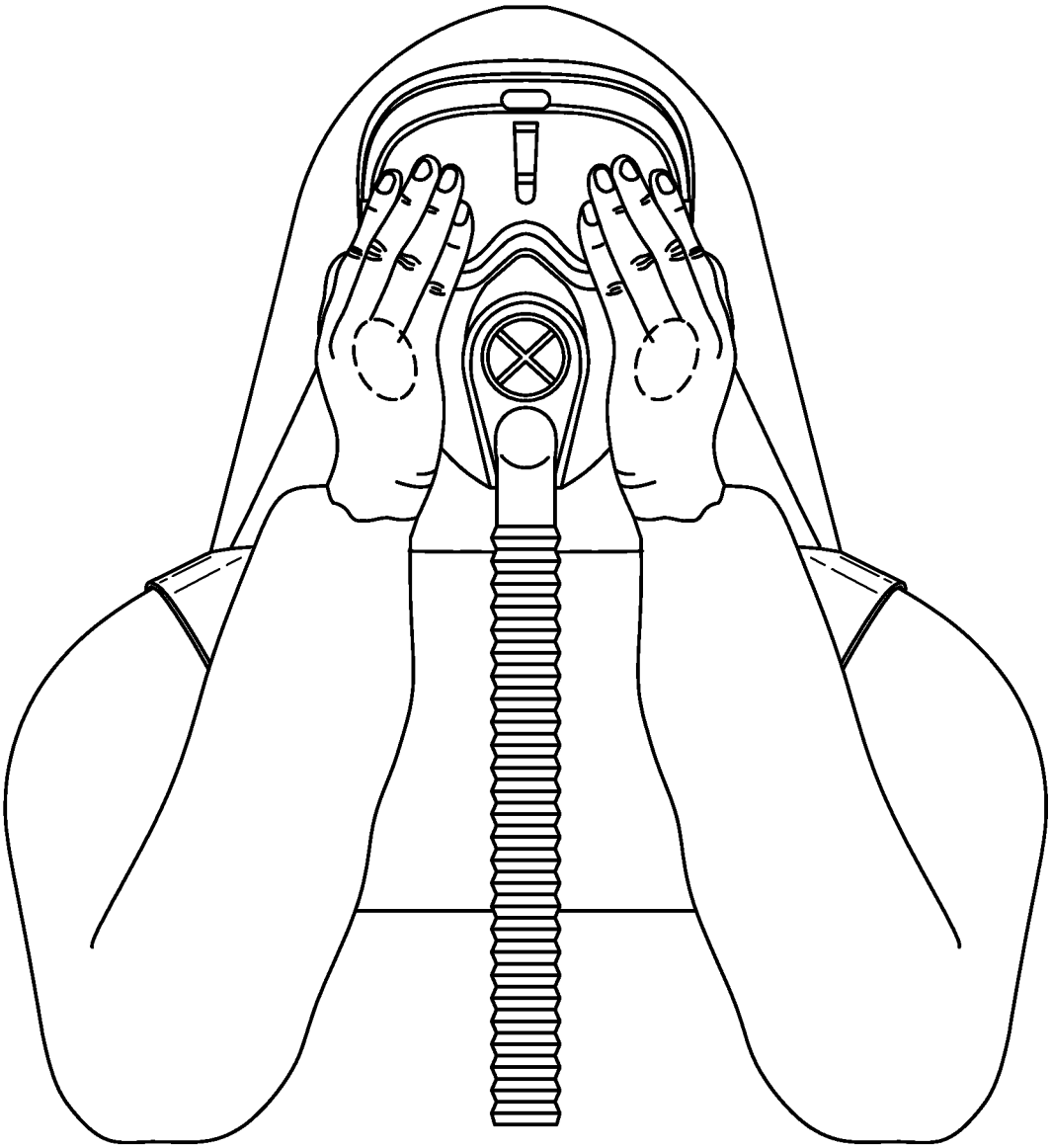
FIG. 10 is an illustration of a user performing a first seal check according to an embodiment of the disclosure.
Figure 11:
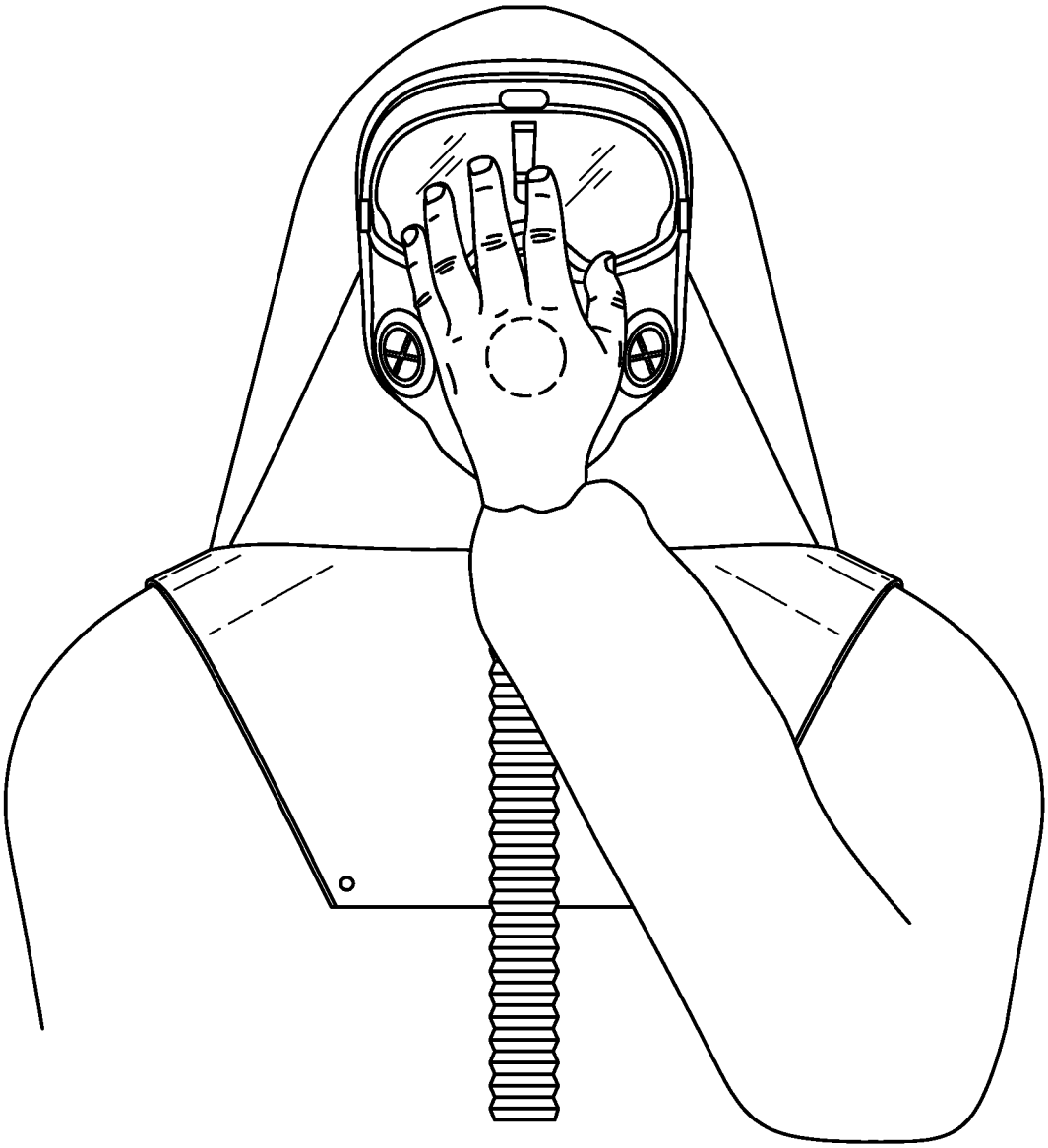
FIG. 11 is an illustration of a user performing a second seal check according to an embodiment of the disclosure.

Turning now to FIG. 10 and FIG. 11, a method of testing the abrasive blast respirator 50 is described. A user may first invert the hood 210 (or otherwise move the hood to make the rear of the facepiece accessible) so the inside of the hood 210 is on the outside, the back of the full facepiece 104 is accessible, and the harness or head straps are free to hand. The user may place the facemask in position with respect to the face, and/or place the harness over his or her head, adjusting the position of the face seal 130 and adjusting the tightness of the harness (by for example tightening straps). The user may then pull the hood 210 down over his or her head, thereby causing the hood 210 to revert an the inside of the hood 210 surrounds the user's head and shoulder and the outside of the hood 210 again faces outwards. The user may optionally couple the sternum strap 214 to a buckle coupled to a front inside of the hood 210.

If the protective cover 108 is coupled to the full facepiece 104, the user may remove it. While the filter 106 is installed and the breathing hose assembly 52 is not supplied with pressurized breathing air (or not in place with the inhalation valve), the user may perform a first test of the fit of the face seal 130 with the face of the user by covering the outside of the filter(s) 106 as illustrated in FIG. 10, thereby preventing inflow of air into the filter(s) 106 from outside the abrasive blast respirator 50. Typically, the filter(s) 106 might be covered by the user's hand (although in other embodiments other forms of covering or closing the filters could be employed). While covering and/or blocking the filter(s) 106, the user attempts to inhale. Inhaling while covering the filter(s) may provide a negative pressure seal check. Because air is prevented from flowing in from the breathing hose assembly 52 (due to closure of the inhalation valve from lack of positive pressure supplied air), from the exhalation valve 122 that implements a one-way air flow, or the filter 106 (due to covering) in this configuration, the only possible in-flow path would be past the face seal 130 and the user's face (if the seal is insufficient). If (the user detects/feels) air flows around the edge of the face seal 130 during this test, the user should adjust the harness accordingly (for example retightening the straps) and retest until air does not flow around the edge of the face seal 130 during this test. This test may be referred to in some contexts as a negative test, because the test involves inducing a negative pressure differential inside the full facepiece 104 with reference to ambient pressure.

The user may also, or alternatively, cover or block the exhalation valve 122 as illustrated in FIG. 11 (typically using the user's hand), thereby preventing outflow of air from inside the abrasive blast respirator 50 through the exhalation valve 122. While blocking the exhalation valve 122, the user attempts to exhale. Exhaling while covering the exhalation valve may provide a positive pressure seal check. Because air is prevented from flowing out the inhalation valves by one-way check mechanisms and from flowing out the exhalation valve by blocking, the only possible out-flow path would be past the face seal 130 and the user's face. If (the user detects/feels) air flows around the edge of the face seal 130 during this test, the user should adjust the harness accordingly (for example, retightening the straps) and retest until air does not flow around the edge of the face seal 130 during this test. This test may be referred to in some contexts as a positive test, because the test involves inducing a positive pressure differential inside the full facepiece 104 with reference to ambient pressure. Once the testing/check(s) have been performed and the seal is sufficient, the user may attach (or reattach) the protective cover. One or more of the tests/checks may be made easier to perform by locating one or more of the elements of the respirator external to the hood (typically on the facepiece, and often on the front of the facepiece within the field of view of the base lens view area). Such a location allows ready access to elements for testing without the need to move, reposition, or reconfigure the hood from its standard abrasive blasting configuration/position. Additionally, such a location may allow a user to employ visual cues when perform the test (rather than having to rely on blind feel, for example, if the elements were instead located under the hood). Thus, this type of location may allow testing without the need for the user to lift or reach under the hood. One or more protective covers may be removably attached to the facepiece to shield elements from the abrasive blasting environment during blasting, while allowing ready access to the elements for testing (by for example snapping off the cover to perform the test(s) and then snapping the cover back on after the testing). So in some embodiments, the inhalation valve/breathing hose, exhalation valve, and/or filter(s) may be located on the facepiece external to the hood (when the hood is worn in its standard configuration, and interaction with one or more of these elements may occur external to the hood, and typically based on visual cues).

Figure 12:
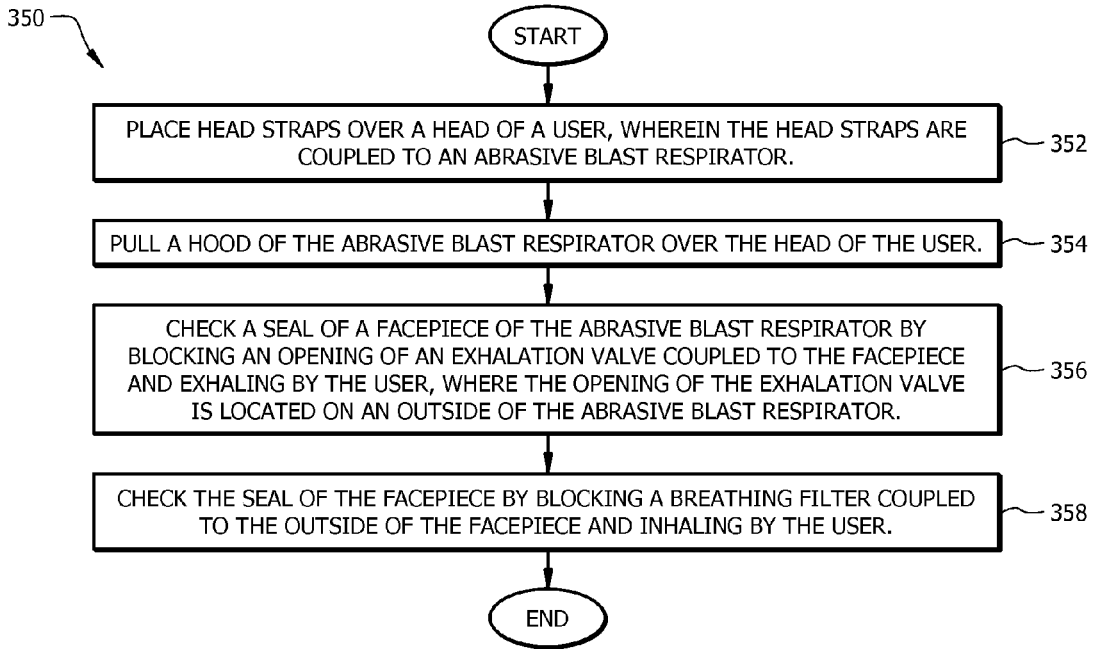
FIG. 12 is a flow chart of a method according to an embodiment of the disclosure.

Turning now to FIG. 12, an illustrative method 350 is described. At block 352, head straps are placed over a user's head, wherein the head straps are coupled to an abrasive blast respirator, for example to the face seal 130 of the full facepiece 104. At block 354, a hood of the abrasive blast respirator is pulled over the head of the user. At block 356, a seal of the facepiece of the abrasive blast respirator is checked by blocking an opening of an exhalation valve coupled to the facepiece and exhaling by the user, where the opening of the exhalation valve is located on an outside of the abrasive blast respirator. At block 358, the seal of the facepiece is checked by blocking a breathing filter coupled to the outside of the facepiece, for example the filter 106, and inhaling by the user. If air is found to flow around the seal of the facepiece with the face of the user, the head straps may be adjusted and the activity of blocks 356 and 358 may be repeated. A protective cover may be removed and/or attached to the facepiece in some embodiments. In an embodiment, the method 350 may further comprise attaching, removing, and/or reattaching a lens magazine by the user while wearing the abrasive blast respirator. In an embodiment, the method 350 may further comprise removing a lens from a lens magazine attached to the abrasive blast respirator, where removing the lens is performed with a gloved hand of the user, typically a single gloved hand, while the user is wearing the abrasive blast respirator. In an embodiment, the removing of the lens may be performed by gripping a lens tab coupled to the lens.

Figure 13:
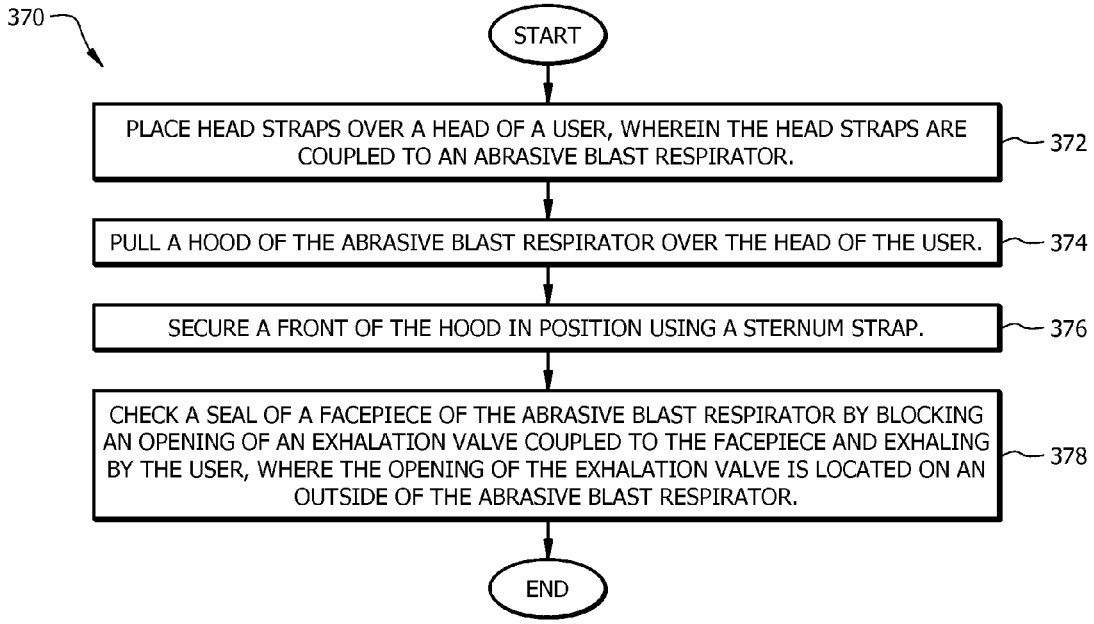
FIG. 13 is a flow chart of another method according to an embodiment of the disclosure.

Turning now to FIG. 13, an illustrative method 370 is described. At block 372, head straps are placed over a user's head, wherein the head straps are coupled to an abrasive blast respirator, for example to the face seal 130 of the full facepiece 104. At block 374, a hood of the abrasive blast respirator is pulled over the head of the user. At block 376, a front of the hood is secured in position using a sternum strap. At block 378, a seal of the facepiece of the abrasive blast respirator is checked by blocking an opening of an exhalation valve coupled to the facepiece and exhaling by the user, where the opening of the exhalation valve is located on an outside of the abrasive blast respirator. If air is found to flow around the seal of the facepiece with the face of the user, the head straps may be adjusted and the activity of block 378 may be repeated. The method 370 may further comprise attaching and/or removing a protective cover from the facepiece, and/or attaching and/or removing a lens magazine from the facepiece.

Figure 14:
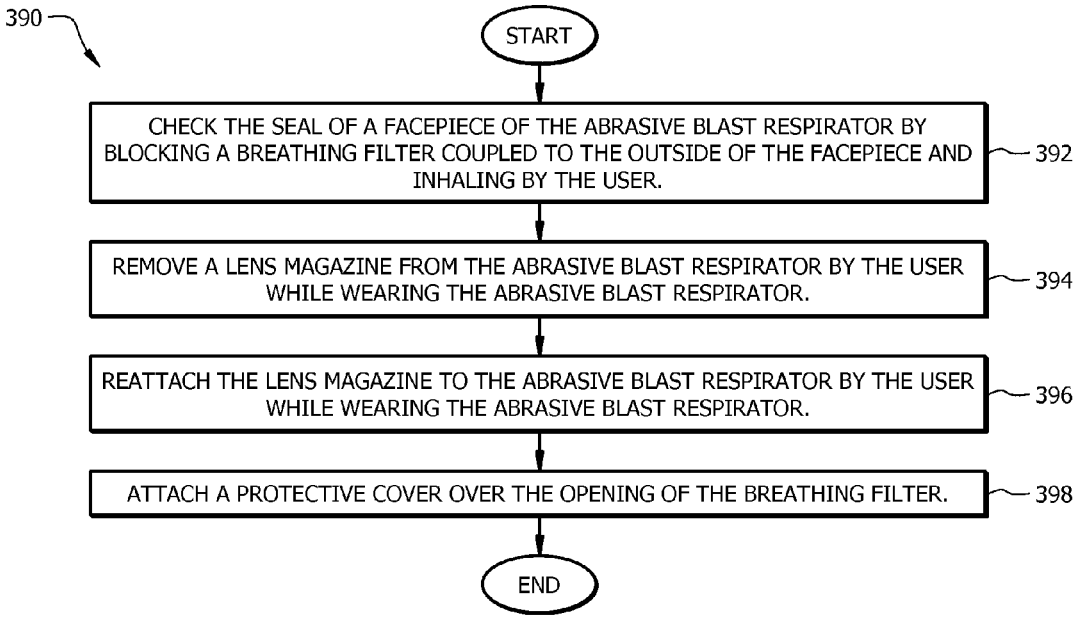
FIG. 14 is a flow chart of another method according to an embodiment of the disclosure.

Turning now to FIG. 14, an illustrative method 390 is described. At block 392, the seal of a facepiece is checked by blocking a breathing filter coupled to the outside of the facepiece, for example the filter 106, and inhaling by the user. If air is found to flow around the seal of the facepiece with the face of the user, the head straps may be adjusted and the activity of block 392 may be repeated. At block 394, a lens magazine is removed from the abrasive blast respirator by the user while wearing the abrasive blast respirator. At block 396, the lens magazine is reattached to the abrasive blast respirator by the user while wearing the abrasive blast respirator. At block 398, a protective cover is attached over the opening of the breathing filter. For example the protective cover 108 is attached over the filter 106 and the end of the breathing hose 52. In an embodiment, the activities of method 390 may be performed by a user wearing the abrasive blast respirator 50 and while wearing gloves.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A method of donning a supplied-air abrasive blast respirator comprising a hood and an attached facepiece including an exhalation valve on the facepiece, a supplied-air inhalation valve on the facepiece, and one or more breathing filter on the facepiece, the method comprising the steps of:

inverting the hood;

placing the facepiece of the respirator in position on a user's face;

placing head straps over a head of the user, wherein the head straps are coupled to the abrasive blast respirator, and tightening the head straps, to form a seal of the facepiece of the respirator to the user's face;

reverting the hood of the abrasive blast respirator by pulling the hood down over the head and shoulders of the user to place the hood in abrasive blasting configuration;

checking the seal of the facepiece of the abrasive blast respirator by blocking an opening of the exhalation valve coupled to the facepiece and exhaling by the user to perform a positive seal check, where the opening of the exhalation valve is located on an outside of the facepiece of the abrasive blast respirator exterior to the hood; and checking the seal of the facepiece by blocking the one or more breathing filter coupled to the outside of the facepiece exterior to the hood and inhaling by the user to perform a negative seal check, while the respirator is not supplied with pressurized breathing air through the supplied-air inhalation valve;

wherein, after reverting the hood, the exhalation valve is external to the hood but shielded from the abrasive blast environment except during checking of the seal, the supplied-air inhalation valve is external to the hood but shielded from the abrasive blast environment except during checking of the seal, and the one or more breathing filter is external to the hood but shielded from the abrasive blast environment except during checking of the seal.

2. The method of claim 1, further comprising removably attaching a lens magazine to the facepiece of the abrasive blast respirator by the user while wearing the abrasive blast respirator.

3. The method of claim 1, further comprising removing a lens from a lens magazine attached to the abrasive blast respirator, where the removing is performed with a single gloved hand of the user.

4. The method of claim 3, wherein the lens is an impact resistant material comprising molded plastic.

5. The method of claim 4, wherein the molded plastic lens comprises polycarbonate material.

6. The method of claim 1, further comprising removing a lens from a lens magazine attached to the abrasive blast respirator by gripping a lens tab coupled to the lens and pulling the lens tab, wherein the lens magazine comprises a plurality of lenses, and each lens comprises a lens tab located on a front of the lens.

7. The method of claim 1, further comprising removably attaching a single protective cover over the exhalation valve and the one or more breathing filter and the supplied-air inhalation valve external to the hood, wherein removable attachment of the protective cover allows for checking of the seal without having to move, reposition, or reconfigure the hood from abrasive blasting configuration.

8. The method of claim 1, wherein performing a negative seal check of the facepiece comprises blocking a first breathing filter coupled to the outside of the facepiece with the user's hand, blocking a second breathing filter coupled to the outside of the facepiece with the user's hand, and inhaling by the user.

9. A method of testing a seal of an abrasive blast respirator, comprising:

checking a seal of a facepiece of the abrasive blast respirator by blocking an opening of an exhalation valve coupled to the facepiece and exhaling by the user, where the opening of the exhalation valve is located on an outside of the facepiece, external to a hood of the respirator;

wherein checking a seal of a facepiece occurs while the hood is configured for abrasive blasting, without having to move, reposition, or reconfigure the hood from abrasive blasting configuration; and wherein the exhalation valve is shielded from an abrasive blast environment during blasting, while allowing access to the exhalation valve for checking of the seal.

10. The method of claim 9, further comprising:

inverting the hood;

placing head straps over a head of a user, wherein the head straps are coupled to an inside of the abrasive blast respirator within the hood;

reverting the hood of the abrasive blast respirator by pulling the hood down over the head and shoulders of the user to place the hood in abrasive blasting configuration;

securing a front of the hood in position using a sternum strap.

11. The method of claim 9, wherein blocking an opening of an exhalation valve comprises covering the opening with a user's hand.

12. The method of claim 9, wherein the abrasive blast respirator further comprises a supplied-air inhalation valve, and wherein checking the seal occurs while the abrasive blast respirator is not supplied with pressurized breathing air via the supplied-air inhalation valve.

13. The method of claim 9, wherein the abrasive blast respirator further comprises a supplied-air inhalation valve, the method further comprising removably attaching a single protective cover over the opening of the exhalation valve and the inhalation valve, such that the removable protective cover shields the exhalation valve and supplied-air inhalation valve from the abrasive blast environment during abrasive blasting.

14. A method of testing a seal of a supplied-air abrasive blast respirator, comprising:

checking the seal of a facepiece of the abrasive blast respirator by blocking one or more breathing filter located on the outside of the facepiece external to a hood of the respirator, and inhaling by a user while the respirator is not supplied with pressurized breathing air.

15. The method of claim 14, wherein checking the seal of the facepiece comprises blocking a first breathing filter coupled to the outside of the facepiece with the user's first hand, blocking a second breathing filter coupled to the outside of the facepiece with the user's second hand, and inhaling by the user.

16. The method of claim 14, wherein checking the seal occurs without reconfiguring, repositioning, or moving the hood from abrasive blasting configuration.

17. The method of claim 16, further comprising removably attaching a single protective cover over the one or more breathing filter and a supplied-air inhalation valve external to the hood, wherein the protective cover is configured so that, when removably attached, the protective cover shields the one or more breathing filter and supplied-air inhalation valve from an abrasive blast environment.

18. The method of claim 14, further comprising checking a seal of the facepiece by blocking an opening of an exhalation valve coupled to the facepiece and exhaling by the user to perform a positive seal check wherein the opening of the exhalation valve is located on the outside of the abrasive blast respirator external to the hood.

19. The method of claim 18, further comprising removing a single removable protective cover from over the one or more filters and the exhalation valve prior to checking of the seal, and reattaching the removable protective cover over the one or more filters and the exhalation valve after checking the seal; wherein the protective cover is configured so that, when removably attached, the protective cover shields the one or more breathing filter and exhalation valve from an abrasive blast environment.

20. The method of claim 19, wherein removing of the protective cover, and reattaching the protective cover after checking the seal is performed with gloved hands by the user; wherein the protective cover is reattached to the front of the facepiece, external to the hood; and wherein removable attachment of the protective cover allows for checking of the seal without having to move, reposition, or reconfigure the hood from abrasive blasting configuration.

* * * * *